US005139739A

United States Patent [19]

Takayanagi et al.

[11] Patent Number: 5,139,739

[45] Date of Patent: Aug. 18, 1992

[54] GOLD ALLOY FOR BLACK COLORING, PROCESSED ARTICLE OF BLACK COLORED GOLD ALLOY AND METHOD FOR PRODUCTION OF THE PROCESSED ARTICLE

[75] Inventors: Takeshi Takayanagi, Aichi; Noboru Morita; Chusei Seki, both of Tokyo, all of Japan

[73] Assignees: Agency of Industrial Science & Technology; Ministry of International Trade & Industry; Seki Company, Tokyo, Japan

[21] Appl. No.: 682,898

[22] Filed: Apr. 9, 1991

Related U.S. Application Data

[62] Division of Ser. No. 438,324, Nov. 20, 1989, abandoned.

[30] Foreign Application Priority Data

Feb. 28, 1989 [JP] Japan ..... 1-45420

[51] Int. Cl.[5] ..... C22C 5/00

[52] U.S. Cl. ..... 420/507; 420/508; 420/509; 420/510; 420/512

[58] Field of Search ..... 420/507-512

[56] References Cited

U.S. PATENT DOCUMENTS 3,189,482 6/1965 Bajars et al. ..... 117/212

FOREIGN PATENT DOCUMENTS 57-5833 1/1982 Japan .
0453443 4/1975 U.S.S.R. ..... 420/511
2066291 7/1981 United Kingdom .
2091294 7/1982 United Kingdom .
2108152 5/1983 United Kingdom .
2138027 10/1984 United Kingdom .
2184457 6/1987 United Kingdom .

OTHER PUBLICATIONS

McDonald et al., Gold Bulletin, vol. 11, (Jul. 1978) 66.
Ott et al., Gold Bull. 18 (1985) 140.
Susz et al., Gold Bull. 13 (1980) 15.
MacCormack et al., Gold Bull. 14 (1981) 19.
German et al., Gold Bull., vol. 13 (1980) 113.

*Primary Examiner*—Upendra Roy
*Attorney, Agent, or Firm*—Oblon, Spivak, McClelland, Maier & Neustadt

[57] ABSTRACT

A gold alloy for black coloring comprising gold and at least one coloring metallic element selected from the group consisting of Cu, Fe, Co, and Ti, a gold alloy for black coloring having the composition described above and further comprising at least one alloying element selected from the group consisting of Pt, Pd, Rh, Ir, Ru, Os, Ag, and Ni; a method for the production of a processed article of gold alloy possessing a black surface layer by the steps of shaping the gold alloy mentioned above, heat-treating the shaped gold alloy, and cooling; and processed article of gold alloy obtained by the method.

5 Claims, No Drawings

GOLD ALLOY FOR BLACK COLORING, PROCESSED ARTICLE OF BLACK COLORED GOLD ALLOY AND METHOD FOR PRODUCTION OF THE PROCESSED ARTICLE

This application is a division of application Ser. No. 07/438,324, filed on Nov. 20, 1989, now abandoned.

BACKGROUND OF THE INVENTION

1. Field of the Invention

This invention relates to a gold alloy suitable for producing a colored gold alloy possessing a glossy black surface layer and used in ornaments of precious metal, a processed article of gold alloy, and a method for the production of the processed article.

2. Prior Art Statement

As ornaments of gold, processed articles of 18-carat gold, i.e. an alloy having a gold content of 75% by weight are widely available on the market. The 18-carat gold is characterized by possessing the stablest mechanical, physical, and chemical properties, excelling in workability, and permitting easy variation of hue. The processed articles of gold inherently have a gold hue and, because of this hue, are esteemed highly as ornaments. In recent years, processed articles of gold have become increasingly intricate in design and demand for such articles in a wider variety of hues has increased.

The hues in which the products of gold alloys meeting this demand are currently available include a light greenish yellow color of the Au-Ag alloy (Metal Data Book, page 186, Maruzen, 1984), a yellow color of the Au-Ag-Cu alloy (ibid.), a red color of the Au-Cu alloy (ibid.), and a light yellowish white color of the Au-Cu-Ni alloy (ibid.). Very recently, a purple color of the Au-Al alloy (Metal, Nov. issue, page 30, Agne's, 1984) and a yellowish green color of the Au-Cd alloy (Nonferrous Metals, II, page 231, compiled by Japan Metallurgical Society, 1986) have been developed.

With only five colors available (white, yellow, red, purple, and yellowish green), however, there are limits on the color variation of gold ornaments that can be obtained. Thus, the desirability of developing gold alloys of colors other than the colors mentioned above, particularly gold alloys of a black color forming a very fine contrast with the golden color, has been finding growing recognition.

SUMMARY OF THE INVENTION

This invention has been accomplished in answer to the desire mentioned above.

To be specific, this invention is directed to:

a gold alloy for black coloring consisting essentially of gold and at least one coloring metallic element selected from the group consisting of Cu, Fe, Co, and Ti and containing the coloring metallic element in a concentration in the range of 5 to 65 wt %;

a gold alloy for black coloring consisting essentially of gold, at least one alloying element selected from the group consisting of Pt, Pd, Rh, Ir, Ru, Os, Ag, and Ni, and at least one coloring metallic element selected from the group consisting of Cu, Fe, Co, and Ti, containing the gold in a proportion of at least 38% by weight to the sum of the amount of the gold and the amount of the alloying element, having the content of the coloring metallic element in the gold alloy in the range of 5 to 40% by weight in the case of Cu, 3 to 40% by weight in the case of Fe, 3 to 40% by weight in the case of Co, or 1 to 10% by weight in the case of Ti, and having the total content of component elements other than gold of the gold alloy in the range of 5 to 65% by weight;

gold alloys for black coloring having the compositions described above, further comprising Zn, and containing the Zn in a concentration in the range of 0.5 to 10% by weight;

a processed article of gold alloy possessing a glossy black surface layer, obtained by shaping a gold alloy comprising gold and at least one coloring metallic element selected from the group consisting of Cu, Fe, Co, and Ti and containing the coloring metallic element in a concentration in the range of 5 to 65% by weight, then heat-treating the shaped gold alloy in an oxidizing atmosphere at a temperature not exceeding the melting temperature of the gold alloy, and thereafter cooling the resultant shaped gold alloy;

a processed article of gold alloy possessing a glossy black surface layer, obtained by shaping a gold alloy comprising gold, at least one alloying element selected from the group consisting of Pt, Pd, Rh, Ir, Ru, Os, Ag, and Ni, and at least one coloring metallic element selected from the group consisting of Cu, Fe, Co, and Ti, containing the gold in a proportion of at least 38% by weight to the sum of the amount of the gold and the amount of the alloying element, having the content of the coloring metallic element in the gold alloy in the range of 5 to 40% by weight in the case of Cu, 3 to 40% by weight in the case of Fe, 3 to 40% by weight in the case of Co, or 1 to 10% by weight in the case of Ti, and having the total content of component element other than gold of the gold alloy in the range of 5 to 65% by weight, then heat-treating the shaped gold alloy in an oxidizing atmosphere at a temperature not exceeding the melting temperature of the gold alloy, and thereafter cooling the resultant shaped gold alloy;

processed articles of gold alloys possessing a glossy black surface layer having the compositions described above, further comprising Zn, and containing the Zn in a concentration in the range of 0.5 to 10% by weight;

a method for the production of a processed article of gold alloy possessing a glossy black surface layer, which method consists essentially of shaping a gold alloy comprising gold and at least one coloring metallic element selected from the group consisting of Cu, Fe, Co, and Ti and containing the coloring metallic element in a concentration in the range of 5 to 65% by weight, then heat-treating the shaped gold alloy in an oxidizing atmosphere at a temperature not exceeding the melting temperature of the gold alloy, and thereafter cooling the resultant gold alloy;

a method for the production of a processed article of gold alloy possessing a glossy black surface layer, which method consists essentially of shaping a gold alloy comprising gold, at least one alloying element selected from the group consisting of Pt, Pd, Rh, Ir, Ru, Os, Ag, and Ni, and at least one coloring metallic element selected from the group consisting of Cu, Fe, Co, and Ti, containing the gold in a proportion of at least 38% by weight to the sum of the amount of the gold and the amount of the alloying element, having the content of the coloring metallic element in the gold alloy in the range of 5 to 40% by weight in the case of Cu, 3 to 40% by weight in the case of Fe, 3 to 40% by weight in the case of Co, or 1 to 10% by weight in the case of Ti, and having the total content of component elements other than gold of the gold alloy in the range of 5 to 65% by weight, then heat-treating the shaped gold alloy in an oxidizing atmosphere at a temperature not exceeding the melting temperature of the gold alloy, and thereafter cooling the resultant gold alloy; and method for the production of processed articles of gold alloy, which methods use gold alloys having the compositions described above, further comprising Zn, and containing the Zn in a concentration in the range of 0.5 to 10% by weight.

DETAILED DESCRIPTION OF THE PREFERRED EMBODIMENTS

This invention is based on the development of a novel gold alloy for black coloring. The gold alloy of this invention is characterized by comprising gold and 5 to 65% by weight of at least one coloring metallic element selected from the group consisting of Cu, Fe, Co, and Ni. If the content of the coloring metallic element is less than 5% by weight, the alloy composition cannot acquire the black layer on the surface as aimed at by the coloring treatment. If this content exceeds 65% by weight, the produced gold alloy is no longer capable of retaining the excellent characteristic properties inherent to the gold alloy of this invention.

Part of the gold in the gold alloy may be replaced by at least one member selected from the group consisting of the platinum group elements (Pt, Pd, Rh, Ir, Ru, and Os), Ag, and Ni. In this case, the gold alloy is required to contain the gold in a proportion of at least 38% by weight to the sum of the amount of the gold and the amount of at least one member selected from the group consisting of the platinum group elements, Ag, and Ni. If the proportion is less than 38% by weight, the final produced gold alloy no longer retains the characteristic quality of carat gold. When part of the gold is replaced by at least one member selected from the group consisting of the platinum group elements, Ag, and Ni, the content of the coloring metallic element in the gold alloy is required to be in the range of 5 to 40% by weight in the case of Cu, 3 to 40% by weight in the case of Fe, 3 to 40% by weight in the case of Co, or 1 to 10% by weight in the case of Ti. It is further an essential requirement that the total content of component elements other than gold should be in the range of 5 to 65% by weight.

Now, the production of the gold alloy of this invention will be described.

The gold alloy of this invention can be obtained by combining component metallic elements in ratios corresponding to an alloy composition aimed at and melting the resultant composition under a vacuum or in an atmosphere of inert gas within an arc furnace provided with a water cooled copper crucible or a high-frequency induction furnace.

Generally, the amount of the composition to be melted in one lot is approximately in the range of 50 to 100 g.

The gold, the Cu, Fe, Co, and Ti as coloring metallic elements, and the Pt, Pd, Rh, Ir, Ru, Os, Ag, and Ni as alloying elements usable in place of part of the gold are desired to be as pure as possible. Practically, however, they may contain impurities in a ratio such that the formation of the black layer in the produced gold alloy and the characteristic quality of the gold alloy will not be adversely affected.

The impurities to be contained in the gold alloy of the present invention are desired not to exceed their respective limits (in ppm) indicated below.

$Mg<3$, $Ca<1$, $Al<1$, $Cr<1$, $Pb<0.3$, $C<40$, $S<10$, $P<10$, $Si<10$, and $Mn<10$ Now, the method for producing a processed article of gold alloy possessing a glossy black surface layer from the gold alloy described above will be described.

The ingot of gold alloy produced by melting the component elements in a given mold as described above is melted under a vacuum or in an atmosphere of inert gas such as, for example, argon gas and the resultant melt is cast in a mold made of the suitable refractories such as magnesia, zircon, alumina, mullite, or silica. In this case, it is desired during the course of the casting to improve the filling property of the melt in the cavity of the mold by utilizing the pressure of inert gas or centrifugal force.

Then, on the casting product consequently obtained, proper finishing work such as, for example, filing, flaking, polishing with a grindstone, and buffing, is conducted.

Then, the finished casting product is heated in the atmosphere or in an oxidizing atmosphere kept under a pressure higher or lower than the partial pressure of the oxygen in the atmosphere and subsequently cooled suitably in the medium of air, oil, or water.

The temperature of the heating is lower than the melting point of the alloy composition of the casting product. To be specific, this temperature is approximately in the range of 700° C. to 950° C. when the heating is carried out in the natural atmosphere. Generally, the temperature is not less than 700° C. The duration of the heating is determined by the size of the casting product and the degree of black color of the product. The degree of black color increases in proportion as the duration of the heating is lengthened, for example. When the processed article is a small product such as, for example, a ring or a brooch, the heating time is generally in the range of 20 to 30 minutes. When the processed article has a slightly larger size, the heating time is sufficient in the range of 30 to 60 minutes.

In consequence of the heat treatment performed as described above, the surface layer of the processed article acquires a black color.

When the black color developed on the surface of the processed article by slight buffing performed after completion of the treatment for black color development lacks sufficient gloss, the sufficient gloss can be obtained by exposing the polished surface of the processed article for a brief time to the flame of a gas burner using city gas or liquefied propane gas and buffing the surface.

The addition of zinc is aimed mainly at degassing the alloy composition. When zinc is added during the course of production of the gold alloy, the otherwise possible occurrence of minute bubbles on the surface of the product can be prevented. If the amount of zinc thus added is less than 0.5% by weight, the purpose of its addition is not attained. Conversely, if this amount exceeds 10% by weight, the excess zinc degrades the physical properties of the gold alloy.

Now, the present invention will be described more specifically below with reference to working examples and comparative experiments. The working examples concern gold alloys of 18 carats, 14 carats, and 10 carats which find popular use. Gold alloys of the compositions of this invention produce similar effects. The gold alloys and the processed articles of gold alloy according with the present invention are produced very easily without requiring any special raw material or device.

Thus, the present invention enjoys very high practical utility.

EXAMPLES

A. The following working examples involve gold alloys of 18 carats (Au content 75% by weight), the commonest Au grade.

EXAMPLE 1

A mixture consisting of 75 g of pure Au and 25 g of electrolytic Co was melted by arc melting in an atmosphere of argon gas. The alloy consequently obtained was centrifugally cast under a vacuum in a mold prepared by the lost-wax process. The casting products (ring and brooch) were filed and ground to finish the surface, soaked in the air at 800° C. for 20 minutes for coloring, and subsequently cooled with water. When the processed articles were subsequently polished again by buffing, they acquired a brilliant black color. Consequently, there were obtained processed articles of gold alloy each possessing a glossy black surface layer. The black surface layers were approximately 3 to 4 μm in thickness. These black surface layers were composed of Au-containing CoO.

EXAMPLES 2 TO 16

Mixtures of pure gold with different elements were melted in the same manner as in Example 1. The resultant gold alloys were cast. The casting products (ring and brooch) were soaked in the air and then cooled in the same manner as in Example 1. Consequently, there were obtained processed articles of gold alloy each possessing a glossy black surface layer.

The alloy compositions, the heating conditions, and the black surface layers were as shown in Table 1.

TABLE 1

| | 1 | 2 | 3 | 4 | 5 | 6 | 7 | 8 |
|---|---|---|---|---|---|---|---|---|
| Pure Au | 75 | 75 | 75 | 75 | 75 | 75 | 75 | 75 |
| Oxygen-free Cu | | | | 25 | | | | 15 |
| Electrolytic iron | | | 25 | | 15 | | | |
| Electrolytic Co | 25 | | | | | 15 | | |
| Pure Ti | | 25 | | | | | 8 | |
| Pure Ag | | | | | 10 | 10 | 17 | |
| Electrolytic Ni | | | | | | | | 10 |
| Pure Zn | | | | | | | | |
| Heating temperature (°C.) | 800 | 850 | 750 | 800 | 800 | 850 | 850 | 800 |
| Heating time (min.) | 20 | 20 | 30 | 20 | 20 | 30 | 20 | 20 |
| Medium for cooling | water | air | air | air | air | air | air | air |
| Black surface layer | | | | | | | | |
| Thickness (μm) | 3–4 | 2–3 | 3–4 | 3–4 | 3–4 | 2–3 | 2–3 | 3–4 |
| Composition | Au<br>CoO | Au<br>$TiO_{2-x}$ | Au<br>$Fe_3O_4$ | Au<br>CuO | Au,Ag<br>$Fe_3O_4$<br>$Ag_2O$* | Au,Ag<br>CoO<br>$Ag_2O$* | Au,Ag<br>$TiO_{2-x}$ | Au<br>NiO<br>CuO |

| | 9 | 10 | 11 | 12 | 13 | 14 | 15 | 16 |
|---|---|---|---|---|---|---|---|---|
| Pure Au | 75 | 75 | 75 | 75 | 75 | 75 | 75 | 75 |
| Oxygen-free Cu | | | | 5 | | 15 | | |
| Electrolytic iron | 15 | 7 | | | 24 | 10 | 13 | 9 |
| Electrolytic Co | | 18 | 20 | 20 | | | 10 | 5 |
| Pure Ti | | | 5 | | | | 2 | 1 |
| Pure Ag | | | | | | | | 10 |
| Electrolytic Ni | 10 | | | | | | | |
| Pure Zn | | | | | 1 | | | |
| Heating temperature (°C.) | 850 | 900 | 900 | 800 | 800 | 850 | 900 | 800 |
| Heating time (min.) | 20 | 15 | 15 | 20 | 20 | 20 | 15 | 20 |
| Medium for cooling | air | air | air | air | air | air | air | water |
| Black surface layer | | | | | | | | |
| Thickness (μm) | 3–4 | 3–4 | 2–3 | 3–4 | 3–4 | 3–4 | 3–4 | 3–4 |
| Composition | Au,Ni<br>$Fe_3O_4$ | Au<br>$Fe_3O_4$<br>CoO | Au<br>CoO<br>$TiO_{2-x}$ | Au<br>CoO<br>CuO | Au<br>$Fe_3O_4$<br>ZnO* | Au<br>$Fe_3O_4$<br>CuO | Au<br>$Fe_3O_4$<br>CoO<br>$TiO_{2-x}$ | Au,Ag<br>CoO<br>$Fe_3O_4$<br>$TiO_{2-x}$ |

*small amount

EXAMPLES 17 TO 31

Processed articles of black colored gold alloy were obtained by following the procedure of Example 1, except that the alloy compositions were varied as indicated in Table 2. The black surface layers consequently formed measured 3 to 4 μm in thickness and possessed a beautiful appearance.

TABLE 2

| | 17 | 18 | 19 | 20 | 21 | 22 | 23 | 24 |
|---|---|---|---|---|---|---|---|---|
| Pure Au | 75 | 75 | 75 | 75 | 75 | 75 | 75 | 75 |
| Oxygen-free Cu | 5 | 5 | 10 | 5 | 5 | 5 | 5 | 3 |
| Electrolytic iron | | 10 | | 5 | | 8 | 10 | |
| Electrolytic Co | 10 | | | 5 | 8 | | 10 | 20 |
| Pure Ti | | | 5 | | 2 | 2 | | 2 |
| Pure Ag | 10 | 10 | 10 | 10 | 10 | 10 | | |
| Electrolytic Ni | | | | | | | | |
| Pure Zn | | | | | | | | |
| Heating temperature (°C.) | 750 | 800 | 720 | 800 | 750 | 800 | 750 | 730 |
| Heating time (min.) | 30 | 30 | 30 | 30 | 30 | 30 | 30 | 30 |
| Medium for cooling | air | air | air | air | air | air | air | air |
| Black surface layer | | | | | | | | |

TABLE 2-continued

| Thickness (μm) | 4–6 | 4–6 | 4–6 | 4–6 | 4–6 | 4–6 | 4–6 | 4–6 |
|---|---|---|---|---|---|---|---|---|
| Composition | Au,Ag CoO CuO | Au,Ag CuO $Fe_3O_4$ | Au,Ag CuO $TiO_{2-x}$ | Au,Ag CuO $Fe_3O_4$ CoO | Au,Ag CuO CoO $TiO_{2-x}$ | Au,Ag CuO $Fe_3O_4$ $TiO_{2-x}$ | Au CuO $Fe_3O_4$ CoO | Au CuO CoO $TiO_{2-x}$ |
| | 25 | 26 | 27 | 28 | 29 | 30 | 31 | |
| Pure Au | 75 | 75 | 75 | 75 | 75 | 75 | 75 | |
| Oxygen-free Cu | 2 | | | | | | | |
| Electrolytic iron | 7 | | 9 | | 6 | | 5 | |
| Electrolytic Co | 15 | 10 | | | 6 | 10 | 5 | |
| Pure Ti | 1 | | 1 | 5 | | 1 | 1 | |
| Pure Ag | | 10 | 10 | 15 | 10 | 10 | 10 | |
| Electrolytic Ni | | 5 | 5 | 5 | 2 | 3 | 3 | |
| Pure Zn | | | | | 1 | 1 | 1 | |
| Heating temperature (°C.) | 800 | 800 | 750 | 800 | 800 | 800 | 800 | |
| Heating time (min.) | 30 | 30 | 30 | 30 | 30 | 30 | 30 | |
| Medium for cooling | air | air | air | air | air | air | air | |
| Black surface layer | | | | | | | | |
| Thickness (μm) | 4–6 | 4–6 | 4–6 | 4–6 | 4–6 | 4–6 | 4–6 | |
| Composition | Au CuO CoO $Fe_3O_4$ $TiO_{2-x}$ | Au,Ag CoO | Au,Ag $Fe_3O_4$ | Au,Ag $TiO_{2-x}$ | Au,Ag $Fe_3O_4$ CoO | Au,Ag CoO $TiO_{2-x}$ | Au,Ag CoO $Fe_3O_4$ $TiO_{2-x}$ | |

EXAMPLE 32

A mixture consisting of 75 g of pure Au, 10 g of pure Pd, and 15 g of electrolytic Co was melted and cast in the same manner as in Example 1. The casting products (ring and brooch) consequently obtained were soaked in the air at 800° C. for 20 minutes for coloring, then cooled with air, and polished again by buffing. As a result, beautiful, glossy black products were obtained. The black surface layers formed by the coloring treatment measured 3 to 4 μm in thickness and were composed of Au, Pd, and $Fe_3O_4$.

EXAMPLES 33 TO 42

Processed articles of gold alloy possessing a glossy black surface layer were obtained by following the procedure of Example 1, except that the alloy compositions were varied. The alloy compositions, the heating conditions, and the black surface layers were as shown in Table 3.

TABLE 3

| | 32 | 33 | 34 | 35 | 36 | 37 | 38 | 39 | 40 | 41 | 42 |
|---|---|---|---|---|---|---|---|---|---|---|---|
| Pure Au | 75 | 75 | 75 | 75 | 75 | 75 | 75 | 75 | 75 | 75 | 75 |
| Oxygen-free Cu | | | | 20 | | | | 5 | 10 | | |
| Electrolytic iron | | 15 | | | 20 | 5 | | | 10 | | 9 |
| Electrolytic Co | 15 | | | | | 10 | 15 | 10 | | 10 | 5 |
| Pure Ti | | | 8 | | | | 5 | | | | |
| Pure Pt | | | | 5 | | | 5 | | 5 | 5 | |
| Pure Pd | 10 | 10 | 17 | | | 10 | | 10 | | 10 | 10 |
| Pure Rh | | | | | 5 | | | | | | 1 |
| Heating temperature (°C.) | 800 | 850 | 850 | 800 | 850 | 900 | 900 | 800 | 850 | 900 | 800 |
| Heating time (min.) | 20 | 20 | 20 | 20 | 20 | 15 | 15 | 20 | 20 | 15 | 20 |
| Medium for cooling | air | air | air | air | air | air | air | air | air | water | water |
| Black surface layer | | | | | | | | | | | |
| Thickness (μm) | 3–4 | 2–3 | 2–3 | 3–4 | 3–4 | 3–4 | 2–3 | 3–4 | 3–4 | 3–4 | 3–4 |
| Composition | Au,Pd $Fe_3O_4$ | Au,Pd CoO | Au,Pd $TiO_{2-x}$ | Au,Pt CuO | Au,Ph $Fe_3O_4$ | Au,Pd $Fe_3O_4$ CoO | Au,Pt CoO $TiO_{2-x}$ | Au,Pd CoO CuO | Au,Pt $Fe_3O_4$ CuO | Au,Pd Pt CoO | Au,Pd Rh $Fe_3O_4$ CoO |

EXAMPLES 43 TO 57

Coloring processed articles of gold alloy were obtained by following the procedure of Example 1, except that alloy compositions were varied as indicated in Table 4. The black surface layers consequently formed measured 4 to 6 μm in thickness and possessed a beautiful appearance.

TABLE 4

| | 43 | 44 | 45 | 46 | 47 | 48 | 49 | 50 |
|---|---|---|---|---|---|---|---|---|
| Pure Au | 75 | 75 | 75 | 75 | 75 | 75 | 75 | 75 |
| Oxygen-free Cu | 5 | 5 | 10 | 5 | 5 | 5 | 5 | 3 |
| Electrolytic iron | | 9 | | 5 | | | 5 | |
| Electrolytic Co | 10 | | | 5 | 8 | | 10 | 20 |
| Pure Ti | | | 5 | | 2 | 2 | | 1 |
| Pure Pt | | | 5 | | | 8 | | 1 |
| Pure Pd | 10 | 10 | 5 | 10 | 10 | 10 | 5 | |
| Pure Ir | | 1 | | | | | | |
| Pure Ag | | | | | | | | |

TABLE 4-continued

| | | | | | | | | |
|---|---|---|---|---|---|---|---|---|
| Electrolytic Ni | | | | | | | | |
| Pure Zn | | | | | | | | |
| Heating temperature (°C.) | 750 | 750 | 750 | 750 | 750 | 750 | 750 | 750 |
| Heating time (min.) | 30 | 30 | 30 | 30 | 30 | 30 | 30 | 30 |
| Medium for cooling | air | air | air | air | air | air | air | air |
| Black surface layer | | | | | | | | |
| Thickness (μm) | 4–6 | 4–6 | 4–6 | 4–6 | 4–6 | 4–6 | 4–6 | 4–6 |
| Composition | Au,Pd CuO CoO | Au,Pd CuO $Fe_3O_4$ | Au,Pd CuO $TiO_{2-x}$ | Au,Pd CuO $Fe_3O_4$ CoO | Au,Pd CuO CoO $TiO_{2-x}$ | Au,Pd CuO $TiO_{2-x}$ | Au,Pd CuO $Fe_3O_4$ CoO | Au,Pt CoO CuO |

| | 51 | 52 | 53 | 54 | 55 | 56 | 57 |
|---|---|---|---|---|---|---|---|
| Pure Au | 75 | 75 | 75 | 75 | 75 | 75 | 75 |
| Oxygen-free Cu | 2 | | | | | | |
| Electrolytic iron | 7 | | 9 | | 6 | | 5 |
| Electrolytic Co | 10 | 10 | | | 6 | 10 | 5 |
| Pure Ti | 1 | | 1 | 5 | | | 1 |
| Pure Pt | | | | | 1 | | |
| Pure Pd | 5 | 5 | 10 | 5 | 6 | 6 | 6 |
| Pure Ir | | | | | | | |
| Pure Ag | | 10 | | 10 | 6 | 5 | 5 |
| Electrolytic Ni | | | 5 | 5 | | 3 | 3 |
| Pure Zn | | | | | | 1 | |
| Heating temperature (°C.) | 750 | 750 | 750 | 750 | 750 | 750 | 750 |
| Heating time (min.) | 30 | 30 | 30 | 30 | 30 | 30 | 30 |
| Medium for cooling | air | air | air | air | air | air | air |
| Black surface layer | | | | | | | |
| Thickness (μm) | 4–6 | 4–6 | 4–6 | 4–6 | 4–6 | 4–6 | 4–6 |
| Composition | Au,Pd CuO $Fe_3O_4$ CoO | Au,Ag Pd CoO | Au,Pd Ni $Fe_3O_4$ | Au,Pd Ag,Ni $TiO_{2-x}$ | Au,Ag Pd,Pt $Fe_3O_4$ CoO | Au,Pd Ag,Ni CoO | Au,Pd Ag,Ni $Fe_3O_4$ CoO |

B. The following working examples involved gold alloys of 14 carats (Au content 58.3% by weight).

Processed articles of gold alloy possessing a black surface layer were obtained by following the procedure of Example 1, except that pure Au was mixed with different elements as shown in Table 5. The black surface layers in these products all measured approximately 5 to 6 μm.

TABLE 5

| | 58 | 59 | 60 | 61 | 62 | 63 | 64 | 65 | 66 |
|---|---|---|---|---|---|---|---|---|---|
| Pure Au | 58.3 | 58.3 | 58.3 | 58.3 | 58.3 | 58.3 | 58.3 | 58.3 | 58.3 |
| Oxygen-free Cu | | 41.7 | | 10 | | | | 20 | |
| Electrolytic iron | | | | | 15 | 20 | | | 5 |
| Electrolytic Co | 41.7 | | 15 | | | 21.7 | 36.7 | 21.7 | 15 |
| Pure Ti | | | | | | | 5 | | |
| Pure Pt | | | | | | | | | |
| Pure Pd | | | | | | | | | |
| Pure Rh | | | | | | | | | |
| Pure Ru | | | | | | | | | |
| Pure Ag | | | 26.7 | | 26.7 | | | | 21.7 |
| Electrolytic Ni | | | | 31.7 | | | | | |
| Pure Zn | | | | | | | | | |
| Heating temperature (°C.) | 720 | 720 | 720 | 720 | 720 | 720 | 720 | 720 | 720 |
| Heating time (min.) | 30 | 30 | 30 | 30 | 30 | 30 | 30 | 30 | 30 |
| Black surface layer | | | | | | | | | |
| Thickness (μm) | 5–6 | 5–6 | 5–6 | 5–6 | 5–6 | 5–6 | 5–6 | 5–6 | 5–6 |
| Composition | Au CoO | Au CuO | Au,Ag CoO | Au,Ni CuO | Au,Ag $Fe_3O_4$ | Au $Fe_3O_4$ CoO | Au CoO $TiO_{2-x}$ | Au CuO CoO | Au,Ag $Fe_3O_4$ CoO |

| | 67 | 68 | 69 | 70 | 71 | 72 | 73 | 74 | 75 |
|---|---|---|---|---|---|---|---|---|---|
| Pure Au | 58.3 | 58.3 | 58.3 | 58.3 | 58.3 | 58.3 | 58.3 | 58.3 | 58.3 |
| Oxygen-free Cu | 10 | | | 20 | | 10 | | 10 | 10 |
| Electrolytic iron | | 20 | | | 5 | | 10 | | |
| Electrolytic Co | 15 | | 20 | | 20 | 20 | 20 | 15 | 15 |
| Pure Ti | | | | | | | 2 | | 2 |
| Pure Pt | | | | 21.7 | 14.7 | 5 | | 3.7 | |
| Pure Pd | | 21.7 | 21.7 | | | 6.7 | 6.7 | 10 | 10 |
| Pure Rh | | | | | 2 | | | | 1.7 |
| Pure Ru | | | | | | | 3 | | |
| Pure Ag | | | | | | | | | |
| Electrolytic Ni | 16.7 | | | | | | | | |
| Pure Zn | | | | | | | | 3 | 3 |
| Heating temperature (°C.) | 720 | 720 | 720 | 720 | 720 | 720 | 720 | 720 | 720 |
| Heating time (min.) | 30 | 30 | 30 | 30 | 30 | 30 | 30 | 30 | 30 |
| Black surface layer | | | | | | | | | |
| Thickness (μm) | 5–6 | 5–6 | 5–6 | 5–6 | 5–6 | 5–6 | 5–6 | 5–6 | 5–6 |
| Composition | Au,Ni | Au,Pd | Au,Pd | Au,Pt | Au,Pt | Au,Pt | Au,Pd | Au,Pt | Au,Pd |

TABLE 5-continued

| | | | | | | | | | |
|---|---|---|---|---|---|---|---|---|---|
| | CuO<br>CoO | $Fe_3O_4$ | CoO | Cuo | Rh<br>$Fe_3O_4$<br>CoO | Pd<br>CuO<br>CoO | $Fe_3O_4$<br>CoO<br>$TiO_{2-x}$<br>$RuO_2$ | Pd<br>CuO<br>CoO | Rh<br>CuO<br>CoO<br>$TiO_{2-x}$ |

C. The following working examples involved gold alloys of 10 carats (Au content 41.7% by weight).

Processed articles of gold alloy possessing a black surface layer were obtained by following the procedure of Example 1, except that pure Au was mixed with different elements as shown in Table 6. The black surface layers in these products all measured approximately 5 to 6 μm.

TABLE 6

| | 76 | 77 | 78 | 79 | 80 | 81 | 82 | 83 | 84 | 85 | 86 | 87 |
|---|---|---|---|---|---|---|---|---|---|---|---|---|
| Pure Au | 41.7 | 41.7 | 41.7 | 41.7 | 41.7 | 41.7 | 41.7 | 41.7 | 41.7 | 41.7 | 41.7 | 41.7 |
| Oxygen-free Cu | | 58.3 | | | | 10 | 10 | | | 10 | | 5 |
| Electrolytic iron | | | | 20 | | | 5 | 20 | | | 5 | |
| Electrolytic Co | 58.3 | | 20 | | | 26.6 | 26.6 | | 20 | 15 | 15 | 15 |
| Pure Ti | | | | | 10 | 5 | | | | | | |
| Pure Pt | | | | | | | | | 38.3 | | 5 | 7 |
| Pure Pd | | | | | | | | 38.3 | | 23.3 | 28.3 | 15 |
| Pure Ru | | | | | | | | | | | | 3.3 |
| Pure Ag | | | 38.3 | | 48.3 | 16.7 | | | | 10 | | 10 |
| Electrolytic Ni | | | | 38.3 | | | 16.7 | | | | 5 | |
| Pure Zn | | | | | | | | | | | | 3 |
| Heating temperature (°C.) | 700 | 700 | 700 | 700 | 700 | 700 | 700 | 700 | 700 | 700 | 700 | 700 |
| Heating time (min.) | 30 | 30 | 30 | 30 | 30 | 30 | 30 | 30 | 30 | 30 | 30 | 30 |
| Medium for cooling | air | air | air | air | air | air | air | air | air | air | air | air |
| Black surface layer | | | | | | | | | | | | |
| Thickness (μm) | 6 | 6 | 6 | 6 | 6 | 6 | 6 | 6 | 6 | 6 | 6 | 6 |
| Composition | Au<br>CoO | Au<br>CuO | Au,Ag<br>CoO | Au,Ni<br>CoO | Au,Ag<br>$TiO_{2-x}$ | Au,Ag<br>CoO<br>CuO<br>$TiO_{2-x}$ | Au,Ni<br>CuO<br>$Fe_3O_4$<br>CoO | Au,Pd<br>$Fe_3O_4$ | Au,Pt<br>$Fe_3O_4$ | Au,Ag<br>Pd<br>CuO<br>CoO | Au,Ni<br>Pt,Pd<br>CoO<br>$Fe_3O_4$ | Au,Ag<br>Pt,Pd<br>Ru<br>CuO<br>CoO |

COMPARATIVE EXPERIMENTS 1 TO 4

Processed articles of gold alloy were obtained by following the procedure of Example 1, except that pure Au was mixed with different elements as indicted in Table 7. The surface layers formed on these processed articles possessed a color of yellow mixed with gray. The black surface layers contemplated by this invention were not obtained in these processed products.

TABLE 7

| | Comparative Experiment No. | | | |
|---|---|---|---|---|
| Composition | 1 | 2 | 3 | 4 |
| Pure Au | 75 | 75 | 75 | 75 |
| Oxygen-free Cu | | | 1 | |
| Electrolytic iron | | 3 | | 1 |
| Electrolytic Co | 3 | | 2 | 1.5 |
| Pure Ti | | | | 0.5 |
| Pure Pt | | | | 10 |
| Pure Pd | | 10 | | |
| Pure Ag | 22 | 12 | 12 | 12 |
| Electrolytic Ni | | | 10 | |

What is claimed is:

1. A processed article of gold alloy possessing a glossy black surface layer which comprises gold and a coloring metallic oxide, obtained by melting in a vacuum or an inert gas atmosphere an ingot of gold alloy comprising gold and at least one coloring metallic element in a concentration in the range of 5 to 65% by weight selected from the group consisting of Cu, Fe, Co, and Ti, investment casting the melted gold alloy in a vacuum or an inert gas atmosphere, then heat-treating the casting of the gold alloy in an oxidizing atmosphere at a temperature between 700° and 950° C. for 20 to 60 minutes, and thereafter cooling the resultant gold alloy.

2. A processed article of gold alloy possessing a glossy black surface layer which comprises gold and a coloring metallic oxide, obtained by melting in a vacuum or an inert gas atmosphere an ingot of gold alloy comprising gold, at least one coloring metallic element selected from the group consisting of Cu, Fe, Co, and Ti, and Zn, containing said coloring metallic element in a concentration in the range of 5 to 65% by weight and containing Zn in a concentration in the rang of 0.5 to 10% by weight, investment casting the melted gold alloy in a vacuum or an inert gas atmosphere, then heat-treating the casting of the gold alloy in an oxidizing atmosphere at a temperature between 700° and 950° C. for 20 to 60 minutes, and thereafter cooling the resultant gold alloy.

3. A processed article of gold alloy possessing a glossy black surface layer which comprises gold, a coloring metallic oxide, at least one of an alloying element and an alloying element oxide, obtained by melting in a vacuum or an inert gas atmosphere an ingot of gold alloy comprising gold, at least one alloying element selected from the group consisting of Pt, Pd, Rh, Ir, Ru, Os, Ag, and Ni, and at least one coloring metallic element selected from the group consisting of Cu, Fe, Co, and Ti, containing a the gold in a proportion of at least 38% by weight to the sum of the amount of the gold and the amount of the alloying element, having the content of said coloring metallic element in said gold alloy in the range of 5 to 40% by weight in the case of Cu, 3 to 40% by weight in the case of Fe, 3 to 40% by weight in the case of Co, or 1 to 10% by weight in the case of Ti, and having the total content of component elements other than gold of said gold alloy in the range of 5 to 65% by weight, casting the melted gold alloy in a vacuum or an inert gas atmosphere, then heat-treating the casting of the gold alloy in an oxidizing atmosphere at a temperature between 700° and 950° C. for 20 to 60 minutes, and thereafter cooling the resultant gold alloy.

4. A processed article of gold alloy possessing a glossy black surface layer comprising gold, a coloring metallic oxide, at least one of an alloying element and an alloying element oxide, obtained by melting in a vacuum or an inert gas atmosphere an ingot of gold alloy comprising gold, at least one alloying element selected from the group consisting of Pt, Pd, Rh, Ir, Ru, Os, Ag, and Ni, at least one coloring metallic element selected from the group consisting of Cu, Fe, Co, and Ti, and Zn, containing said gold in a proportion of at least 38% by weight to the sum of the amount of said gold and the amount of said alloying element, having the content of said coloring metallic element in said gold alloy in the range of 5 to 40% by weight in the case of Cu, 3 to 40% by weight in the case of Fe, 3 to 40% by weight in the case of Co, or 1 to 10% by weight in the case of Ti, containing Zn in a concentration in the rang of 0.5 to 10% by weight, and having the total content of component elements other than gold of said gold alloy in the range of 5 to 65% by weight, investment casting the melted gold alloy in a vacuum or an inert gas atmosphere, then heat-treating the casting of the gold alloy in an oxidizing atmosphere at a temperature between 700° and 950° C. for 20 to 60 minutes, and thereafter cooling the resultant gold alloy.

5. A processed article of gold alloy possessing a glossy black surface layer which comprises gold, a coloring metallic element, at least one of an alloying element and an alloying element oxide, obtained by melting in a vacuum or an inert gas atmosphere an ingot of gold alloy comprising (a) a gold-based metal selected from the group consisting of (i) gold and (ii) an alloy of gold, consisting of gold and one alloying element selected from the group consisting of Pt, Pd, Rh, Ir, Ru, Os, Ag, and Ni, and (b) at least one coloring metallic element selected from the group consisting of Cu, Fe, Co, and Ti, provided that when said gold-based metal is gold, said coloring metallic element is present in a concentration in the range of 5 to 65 wt. %; and when said gold-based metal is said alloy of gold, said gold is present in a proportion of at least 38% by weight based on the sum of the amount of said gold and the amount of said alloying element, said coloring metallic element in said gold alloy is present in the range of 5 to 40% by weight in the case of Cu, 3 to 40% by weight in the case of Fe, 3 to 40% by weight in the case of Co, or 1 to 10% by weight in the case of Ti, and the total content of component elements other than gold of said gold alloy is in the range of 5 to 65% by weight, investment casting the melted gold alloy in a vacuum or an inert gas atmosphere, then heat-treating the casting of the gold alloy in an oxidizing atmosphere at a temperature between 700° and 950° C. for 20 to 60 minutes, and thereafter cooling the resultant gold alloy.

* * * * *